US011185141B2

(12) United States Patent
Newson

(10) Patent No.: US 11,185,141 B2
(45) Date of Patent: Nov. 30, 2021

(54) WHEELED SUITCASE COMPRISING A RETRACTABLE ROD

(71) Applicant: Louis Vuitton Malletier, Paris (FR)

(72) Inventor: Marc Newson, Londres (GB)

(73) Assignee: Louis Vuitton Malletier, Paris (FR)

( * ) Notice: Subject to any disclaimer, the term of this patent is extended or adjusted under 35 U.S.C. 154(b) by 521 days.

(21) Appl. No.: 16/065,875

(22) PCT Filed: Dec. 20, 2016

(86) PCT No.: PCT/FR2016/053591

§ 371 (c)(1),
(2) Date: Jun. 25, 2018

(87) PCT Pub. No.: WO2017/109397

PCT Pub. Date: Jun. 29, 2017

(65) Prior Publication Data

US 2019/0008254 A1 Jan. 10, 2019

(30) Foreign Application Priority Data

Dec. 24, 2015 (FR) ..... 1563299

(51) Int. Cl.

| | |
|---|---|
| ***A45C 13/26*** | (2006.01) |
| ***A45C 5/14*** | (2006.01) |
| ***A45C 5/03*** | (2006.01) |

(52) U.S. Cl.

CPC ..... *A45C 13/262* (2013.01); *A45C 5/03* (2013.01); *A45C 5/14* (2013.01); *A45C 2005/037* (2013.01); *A45C 2013/267* (2013.01)

(58) Field of Classification Search

CPC ..... A45C 13/262; A45C 5/03; A45C 5/14; A45C 2005/037; A45C 2013/267

See application file for complete search history.

(56) References Cited

U.S. PATENT DOCUMENTS

| | | | | |
|---|---|---|---|---|
| 4,261,447 A * | 4/1981 | Arias | ..... | A45C 5/14 16/113.1 |
| 5,116,289 A * | 5/1992 | Pond | ..... | A45C 5/14 16/113.1 |
| 5,377,795 A | 1/1995 | Berman | | |

(Continued)

FOREIGN PATENT DOCUMENTS

| | | |
|---|---|---|
| DE | 20 2007 000894 | 5/2008 |
| EP | 2522244 A1 | 11/2012 |

(Continued)

OTHER PUBLICATIONS

International Search Report related to Application No. PCT/FR2016/053591; dated Mar. 17, 2017.

*Primary Examiner* — Tri M Mai

(74) *Attorney, Agent, or Firm* — von Briesen & Roper, s.c.

(57) ABSTRACT

The wheeled suitcase comprises:

a rigid or semi-rigid suitcase body (1), mounted on wheels (30), said body (1) comprising at least three rigid or semi-rigid lateral faces (5, 9) separated by two edges (13), and a telescopic twin rod (16) comprising two arms (17), a handle and two tubes, the arms (17) being connected to the handle (18) and slidingly mounted in both tubes (21), said suitcase being characterized in that the two tubes (21) are disposed along the two edges (13) outside the body (1) of said suitcase.

14 Claims, 4 Drawing Sheets

(56) References Cited

U.S. PATENT DOCUMENTS

| | | | | |
|---|---|---|---|---|
| 5,542,510 | A * | 8/1996 | Rekuc | A45C 5/14 16/113.1 |
| 6,357,568 | B1 * | 3/2002 | Chen | A45C 13/36 190/127 |
| 8,302,976 | B2 * | 11/2012 | Okabe | B62B 5/067 280/47.24 |
| 2009/0188764 | A1 * | 7/2009 | Miyoshi | A45C 13/385 190/18 A |
| 2009/0242344 | A1 * | 10/2009 | Selvi | A45C 13/04 190/18 A |
| 2014/0311845 | A1 * | 10/2014 | Ling | A45C 13/262 190/18 A |

FOREIGN PATENT DOCUMENTS

| | | | |
|---|---|---|---|
| FR | 2870693 | A1 | 12/2005 |
| FR | 3 010 283 | | 3/2015 |
| GB | 2441580 | A | 3/2008 |
| JP | 3059236 | U | 7/1999 |
| JP | 2008272316 | A | 11/2008 |
| JP | 2009050463 | A | 3/2009 |
| WO | 9730607 | A1 | 8/1997 |
| WO | 2015063752 | A1 | 5/2015 |
| WO | 2015174966 | A1 | 11/2015 |

* cited by examiner

WHEELED SUITCASE COMPRISING A RETRACTABLE ROD

CROSS-REFERENCE TO RELATED APPLICATION

This Application is a 35 USC § 371 US National Stage filing of international Application No. PCT/FR2016/053591 filed on Dec. 20, 2016, and claims priority under the Paris Convention to French Patent Application No. 15 63299 filed on Dec. 24, 2015.

FIELD OF THE DISCLOSURE

The present invention relates to a wheeled suitcase comprising a suitcase body mounted on wheels and a twin rod connected to a handle, the twin rod being mounted to the body so as to be movable between an extended position allowing a user to manually pull the suitcase and a position that is retracted inside the body.

BACKGROUND OF THE DISCLOSURE

Usually, a movable twin rod is made in the shape of at least two arms, connected by a handle, the two arms being rigid tubes slidingly mounted respectively in the two tubes that are integral with the suitcase body. For example, document FR 2 870 693 describes such an embodiment.

The tubes receiving the arms are positioned inside the suitcase.

As this assembly represents a certain volume that is lost to the suitcase user, and also requires strengthening and attaching parts that mar the esthetic appearance and involve added weight, the tubes and strengthening and attaching parts typically must be hidden for a more esthetic result, for example by means of a cloth lining.

This assembly may also lead to the production of projecting parts on the body faces of the suitcase, which is unsightly.

In addition, the assembly increases the mass of the suitcase, which may be inconvenient to the user, who has to pull the suitcase and who must comply with the suitcase weight limitations imposed by airline companies.

SUMMARY OF THE DISCLOSURE

The particular object of the present invention is to mitigate some or all of these abovementioned disadvantages. For this purpose, the invention proposes a wheeled suitcase comprising:

- a rigid or semi-rigid suitcase body, mounted on wheels, said body comprising at least three rigid or semi-rigid lateral faces separated by two edges, and
- a telescopic twin rod comprising two arms, a handle and two tubes, the arms being connected to the handle and slidingly mounted in both tubes.

In conformance with the invention, the suitcase is remarkable in that the two tubes are disposed along the two edges outside the body of said suitcase.

By positioning the tubes outside the suitcase body, the internal capacity of the suitcase is not reduced and the suitcase bottom is flat. In addition, by positioning the tubes along the edges, the twin rod conforms to part of the contour of a suitcase face. Therefore, the tubes do not project over a face of the suitcase, which makes the suitcase assembly esthetically pleasing.

In compliance with several embodiments that will be described subsequently, the suitcase in conformance with the invention may comprise the following characteristics, taken separately or in combination:

- each of the two edges is recessed, presenting a concavity facing the outside of the suitcase body, the tubes are received in the recessed edges,
- each of the tubes presents a profile with a cross section defined by an outer portion and an inner portion, the outer portion defining an arch presenting two ends, the ends tangentially joining two contiguous lateral faces to the edge in which the tube is received, the inner portion being configured to substantially follow the concavity of said recessed edge in which the tube is received.
- the tubes are attached to the two edges by rivets or screws,
- the tubes present open ends by which the arms are introduced, and a rigid intermediate part is positioned between the tubes and extends from the open end of one tube to the open end of the other tube,
- one of the lateral faces is a rear face of the suitcase body, and said suitcase body comprises a top face separated from the rear face by an upper edge of the suitcase body, said upper edge being recessed, presenting a concavity facing the outside of the suitcase body, the rigid intermediate part being of complementary shape to the concavity of the upper edge and the intermediate part being fixed to said upper edge,
- the handle is movable between a retracted position and an extended position and comprises, on at least one portion of its length, a cross section defined by an outer handle portion and an inner handle portion, the outer handle portion defining an arch presenting two ends, the two ends found in the extension of the planes defined by, respectively, a lateral face of the suitcase body and the top face of the suitcase body,
- the suitcase comprises a free space between the handle and the rigid intermediate part in the retracted position of the handle.
- the suitcase also comprises at least two wheeled devices which are rotatable around two respective pivot axes, said wheeled devices being mounted on a bottom face of the suitcase body,
- the tubes present a tube end situated in the vicinity of a wheeled device, said tube end presenting an edge defining an inner space of the tube, and the pivot axis of the wheeled device extends in said inner space of the tube,
- each wheeled device is attached in the vicinity of a tube with which it is associated, and each of the two pivot axes is parallel to a main tube axis with which said wheeled device is associated, a pivot axis of a wheeled device being spaced apart from an associated main tube axis by a distance of less than 20 millimeters, preferably zero millimeters,
- each of the wheeled devices is attached to an element mounted on a tube,
- the suitcase comprises shock-absorbing devices,
- the shock-absorbing devices are parts mounted on a lateral face of said body of said suitcase, in the vicinity of the tubes, The tubes comprise said shock-absorbing devices.

BRIEF DESCRIPTION OF THE DRAWINGS

Other characteristics and advantages of the invention will appear in the following description of several embodiments, given by way of non-limiting examples, with reference to the attached drawings.

In the drawings.

DETAILED DESCRIPTION OF THE DISCLOSURE

The figures that will be described show an embodiment of a suitcase in compliance with the invention.

In the various figures, the same references designate identical or similar elements. In addition, the terms "lower," "upper," "top," "bottom," "front," "back" etc. are used in reference to the drawings for further clarity. They should not be understood as being limitations on the scope of the invention.

Figure 1:
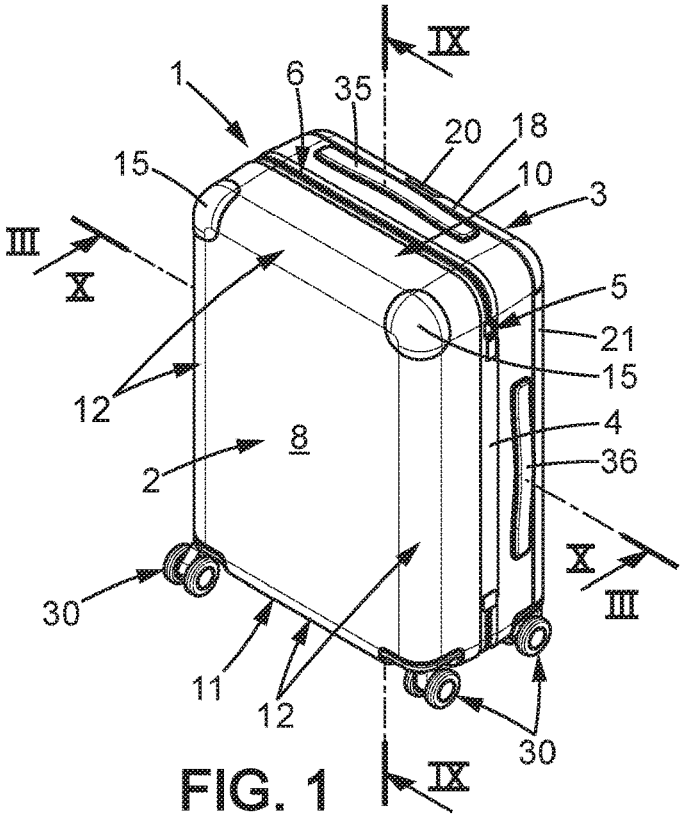
FIG. 1 is a perspective view of a wheeled suitcase in compliance with the invention, wherein the twin rod is in a retracted position.

The suitcase represented in FIG. 1 is of the "trolley" type and comprises a suitcase body 1 comprising two half-shells 2 and 3 with a substantially rectangular cross-section, connected together by a hinge 4 that runs substantially along the entire height of suitcase body 1, on a side 5 of the suitcase (or lateral face 5).

The half-shells 2 and 3 are rigid or semi-rigid shells, for example obtained at least in part by molding.

The half-shells are assembled together by their free edges 7 by means of a zipper 6 running along the entire free edges 7 of the two half-shells 2 and 3.

Figure 3:
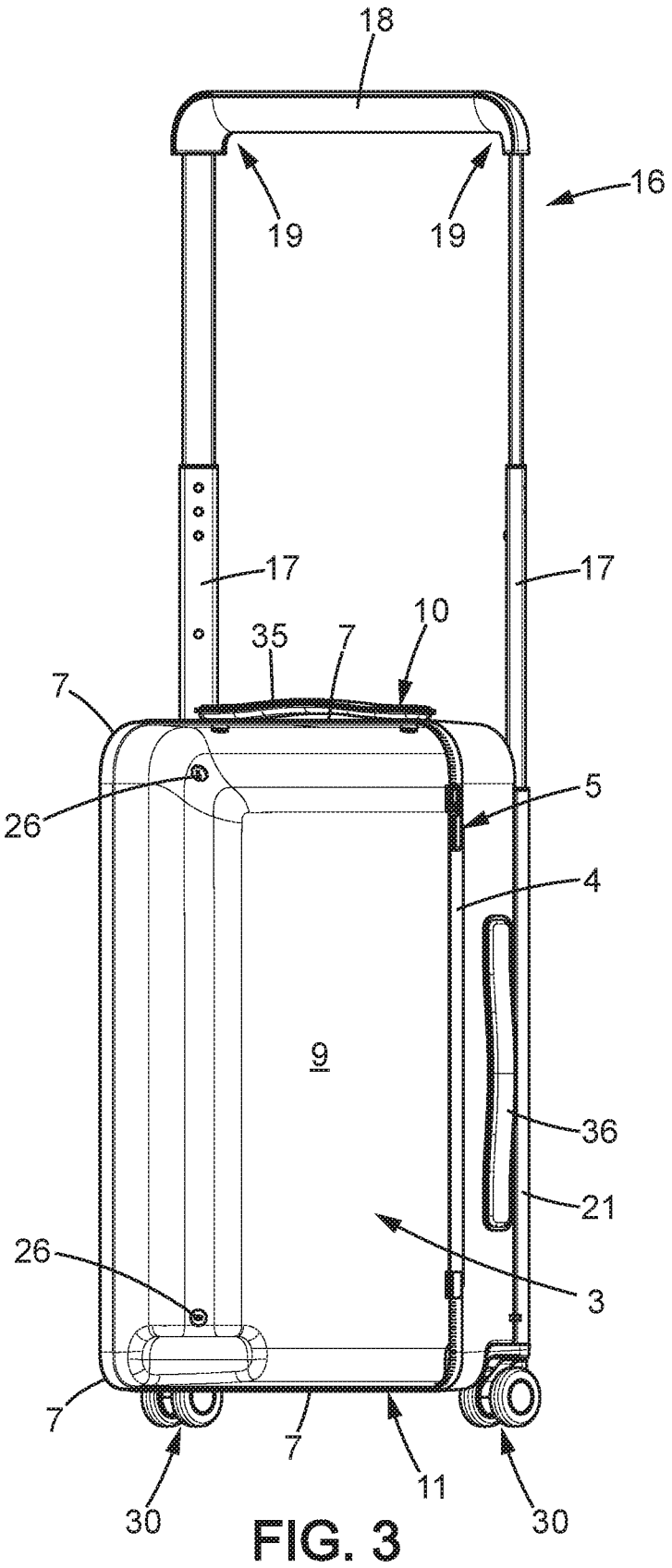
FIG. 3 is a perspective view of part of the suitcase shown in FIG. 2, revealing the inside of the suitcase and especially the bottom of the suitcase bearing the twin rod.

"Free edge 7" will be understood to refer to the edge of each of the half-shells that is not connected to hinge 4. FIG. 3, illustrating a single half-shell 3, shows the free edge 7 of the half-shell 3.

The two assembled half-shells 2 and 3 form the six lateral faces of the wheeled suitcase: Two lateral faces 5, a front face 8, a back face 9, a top face 10 and a bottom face 11.

The two lateral faces 5, top face 10 and bottom face 11 are formed by two lateral edges of the half-shells interconnected by hinge 4 or by zipper 6.

Figure 2:
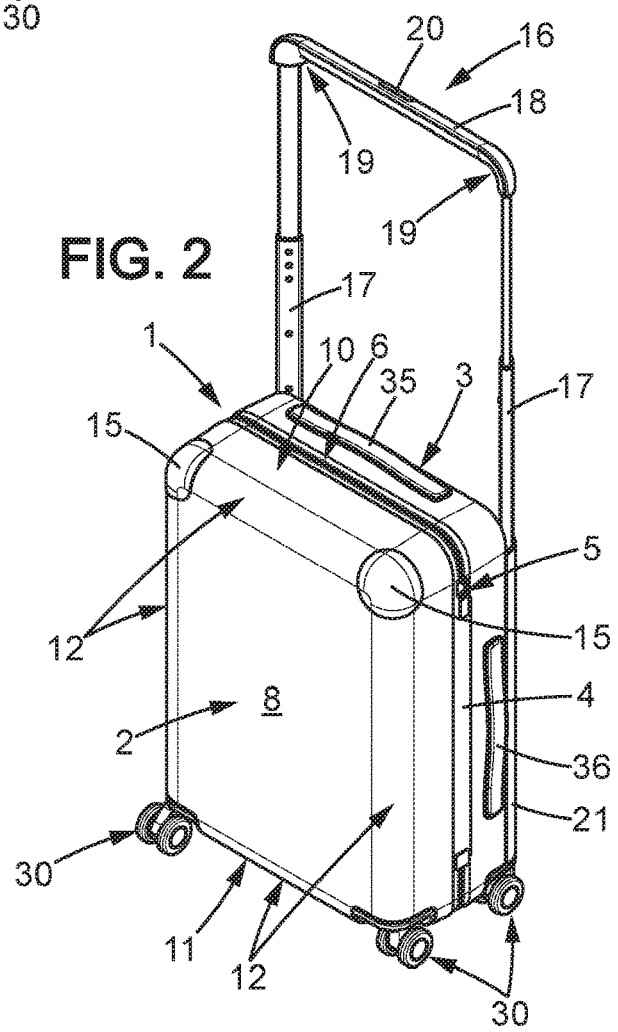
FIG. 2 is a perspective view of the suitcase shown in FIG. 1, wherein the twin rod is in an extended position.

Front 8 and back 9 faces also constitute lateral faces of the suitcase when body 1 is positioned upright (see in FIGS. 1 and 2 for example).

Top and bottom lateral faces 5, 8 and 9 (comprising front and back faces) are defined by edges 12, 13 or 14 of body 1.

Half-shell 2 comprises the four edges of the front face of suitcase body 1. Edges 12 are rounded. In the examples illustrated by the figures, two strengthening elements 15 are attached to the upper corners of half-shell 2.

Half-shell 3 forming the back of suitcase body 1 presents two recessed lateral edges 13, the recess forming a concavity, and the concavity facing the outside of the suitcase body. The recessed edge can also be called a flanged edge.

It must be understood that producing a recessed edge is not an essential characteristic of the invention and that the latter could apply to embodiments according to which the edges are flat, for example.

Half-shell 3 also presents an upper edge 14 of the suitcase body, separating the back face 9 from the top face 10 of the suitcase body. Upper edge 14 is also recessed, the concavity of which faces the outside of suitcase body 1. The edge separating the bottom face 11 from the back face 9 is a rounded edge 12, like the edges of the half-shell forming the front of suitcase body 1.

Suitcase body 1 is mounted on four wheeled device 30 sets, each device comprising two wheels.

It should be understood that the wheeled devices can be different without departing from the context of the invention; for example, the devices may only comprise a single wheel or more than two wheels.

Each wheeled device 30 is mounted and fixed to a corner of the lower face 11 of suitcase body 1.

Each of the wheeled devices is mounted to be movable around an axis X1 which is parallel to the direction of edges 12 or 13 of suitcase body 1.

It should be understood that the invention is not limited to the presence of four wheeled devices: In fact, the suitcase may only comprise two wheeled devices, without departing from the context of the invention.

In the example illustrated, two of the four wheeled devices are associated with two tubes 21 by being attached under the lower ends of both tubes 21.

The lower ends 39 (FIG. 4) of tubes 31 comprise edges (not illustrated) that define an inner space of the tube.

In the context of the embodiment illustrated (see FIG. 4), the invention provides that pivot axes X1 of wheeled devices 30 associated with tubes 21 extend into the inner space of respective tubes 21 with which they are associated. More specifically, pivot axis X1 and axis X of the tubes coincide.

Another embodiment (not illustrated) may also be provided, according to which each wheeled device is attached in the vicinity of a tube with which it is associated, and each of the two pivot axes is parallel to a main tube axis X with which said wheeled device is associated, a pivot axis X1 of a wheeled device being spaced apart from an associated main tube axis X by a distance of less than 20 millimeters.

In such a case, the pivot axis of the wheeled devices is offset from the tube axis.

Preferably, the distance between the pivot axis X1 of a wheeled device and the main axis X of the tube associated with it may be chosen to be zero.

Without departing from the scope of the invention, it may also be provided that each of the wheeled devices is attached to an element mounted on a tube 21.

In compliance with the invention, the wheeled suitcase comprises a telescopic twin rod 16, attached to suitcase body 1, and may adopt a multitude of positions between two extreme positions: A retracted position shown in FIGS. 1 and 6 to 8, and an extended position shown in FIGS. 2 to 5.

The telescopic twin rod 16 comprises two parallel arms 17, each made from one or more rods assembled together.

The telescopic twin rod 16 also comprises a handle 18 connecting the two free ends 19 of both arms 17.

The handle may be equipped with a button 20 for releasing the twin rod when it is in the retracted position so as to enable passage from the retracted position to the extended position.

Figure 4:
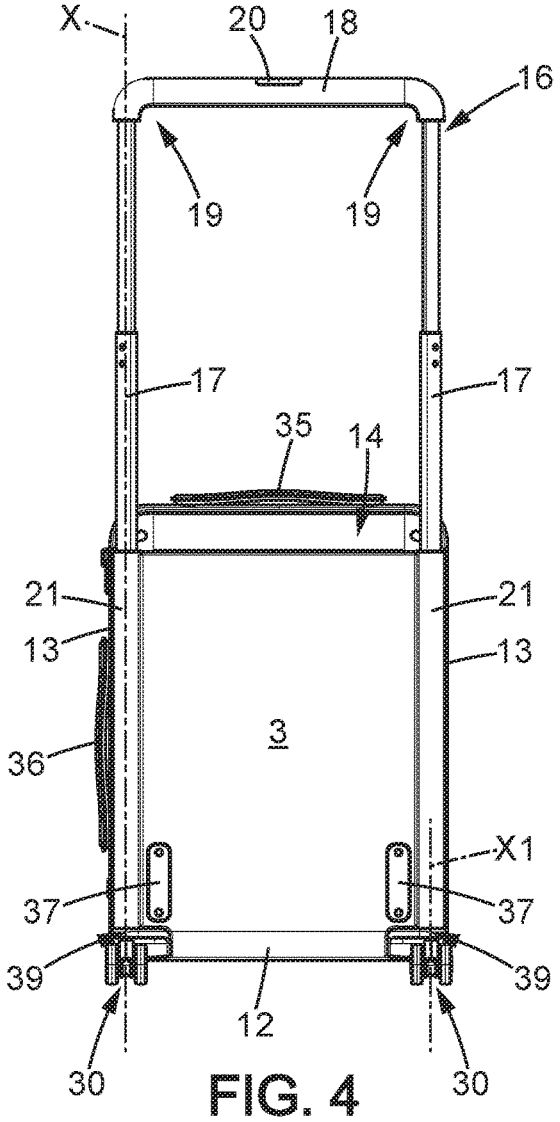
FIG. 4 is a back view of the suitcase illustrated in FIG. 2.
Figure 5:
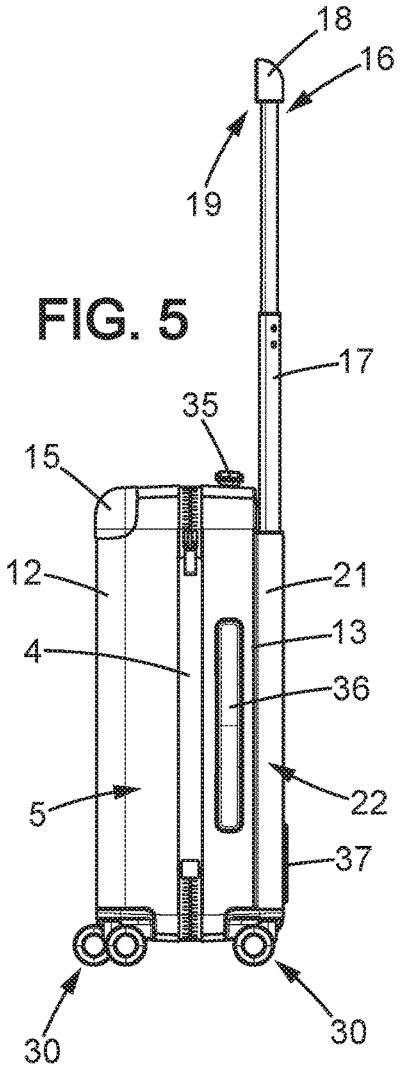
FIG. 5 is a side view of the suitcase illustrated in FIG. 2.

The two arms 17 of twin rod 16 are slidingly mounted in the two tubes 21, and the two tubes 21 are attached along edges 13 of half-shell 3 forming the back of suitcase body 1 outside half-shell 3 and therefore outside suitcase body 1 (see FIGS. 4 and 5 in particular).

In this way, and as may be seen in particular in FIG. 3, the inside of shell 3 presents a perfectly flat bottom and the volume of tubes 21 receiving arms 17 is minimal both inside and outside the suitcase, thanks to the fact that the tubes 21 are placed at the edges of the suitcase.

Figure 10:
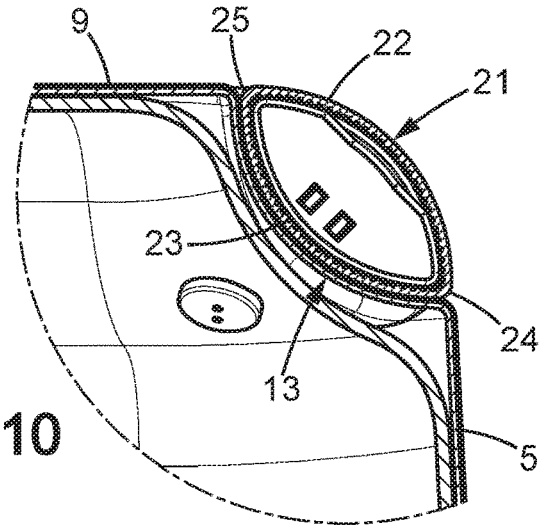
FIG. 10 is a partial cross-sectional view of a lateral part of the suitcase along the plane X-X shown in FIG. 1.

More specifically, the tubes are profiled with a cross section defined by an outer portion 22 and an inner portion 23 (see FIG. 10).

The outer portion 22 defines an arch (or in other words, a curve), the ends 24 and 25 of which tangentially join the lateral 5 and back 9 faces of suitcase body 1 (faces 5 and 9 being contiguous).

In this way, outer portion 22 of tube 21 appears to extend the lateral face 5 and back face 9. Therefore, visually, tubes 21 are incorporated into the extension of the suitcase faces and merge with the volume of the suitcase, the suitcase volume being laterally defined by faces 5, 9 and 8 of the suitcase.

In this way, tubes 21 do not obstruct the inner volume of the suitcase. In fact, if tubes 21 were disposed inside the suitcase, as usual, they could damage the elements contained in the suitcase.

It can also be noted that the capacity of the suitcase (i.e., the inner volume of the suitcase that can accommodate objects, corresponds to at least 80% of the volume defined by the outer surface of the suitcase.

In addition, tubes 21 do not mar the outer esthetic appearance of the suitcase.

Lastly, they do not project outside the suitcase, and are therefore less fragile.

In general, the outer (i.e., visible) surface of tubes 21 engaged in recesses 13 forms suitcase edges that have substantially identical shapes and sizes as edges 12. Therefore, the suitcase body is compact and presents a regular and symmetrical outer shape, which gives the suitcase an elegant and esthetically pleasing shape that is expected by the consumer.

In addition, as shown in FIG. 10, the inner portion 23 of tubes 21 presents a shape that is complementary to that of the recessed shape of edges 13. The inner portion 23 is thus configured to substantially follow the recessed shape of edge 13.

Tubes 21 are attached in the recessed edges 13, for example by means of rivets or screws 26 (see FIG. 3 showing the inside of the suitcase). Tubes 21 may also be fixed in recessed edges 13 by other known fixation means, for example by bonding.

The fact that the tubes are mounted outside the suitcase by riveting or by screwing facilitates the assembly of the suitcase.

In addition, the means for attaching the rod tubes do not damage the integrity of the elements contained in the suitcase. In fact, they are not numerous (two per tube) and they are placed substantially at the ends of the tubes and suitcase edges.

It should be noted that the walls forming the suitcase faces are rigid or semi-rigid. Thus, providing the two crossmembers that are conventionally found on "trolley" type suitcases to connect the tubes is unnecessary.

Figure 8:
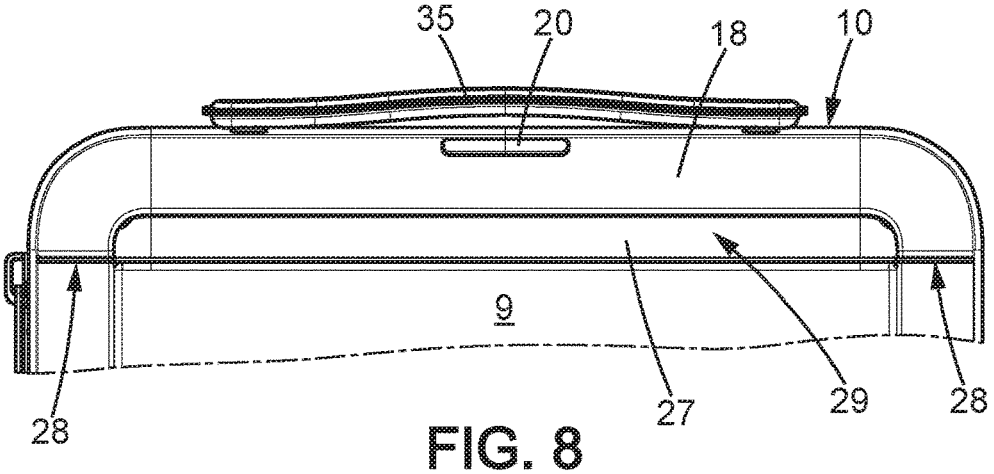
FIG. 8 is a partial back view of the suitcase, with the twin rod in the retracted position.
Figure 9:
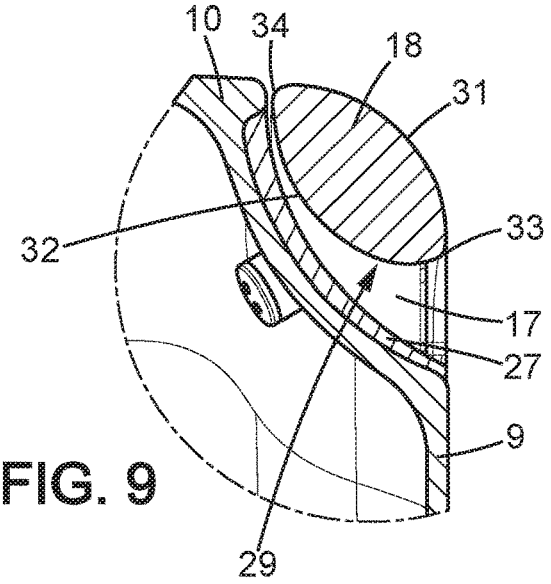
FIG. 9 is a partial cross-sectional view of an upper part of the suitcase along the plane IX-IX shown in FIG. 1.

Instead of such crossmembers, the suitcase in compliance with the invention presents a rigid intermediate part, fixed in the upper recessed edge, that provides more rigidity between the two tubes 21 in the upper part of the suitcase (see FIGS. 8 and 9).

The rigid intermediate part 27 is placed between the open ends 28 of the tubes (the open ends 28 of the tubes receiving arms 17 of twin rod 16), so as to maintain the distance between these two ends. In fact, without this part, the wall forming the back face of suitcase body 1 could deform if the user were to pull the suitcase by a side of the handle 18 or by an arm 17, and the handle could then remain blocked in an intermediate position between the extended position and the recessed position, by an arching or even deformation phenomenon of the arms or tubes.

The intermediate part 27 thus ensures a rigidity of the upper part of the suitcase.

The intermediate part 27 is illustrated in FIG. 9: It is a rigid curved sheet, the shape of which is complementary to that of the upper recessed edge 14 of the suitcase body. The length of the rigid curved sheet is substantially equal to the distance separating the two openings 28 of suitcase tubes 21.

Other rigid curved sheets can also be provided in the bottom of the recesses of the recessed edges 13, between the bottom of the recessed edges and the tubes 21.

Such rigid curved sheets are thin and their mass adds practically no weight to the suitcase: in all cases, their mass is much less than the mass of the crossmembers usually present in "trolley" type suitcases.

The suitcase thus remains light and elegant.

The handle 18 is also shaped so that, when the handle is in the retracted position (FIGS. 1 and 6 to 8), it is incorporated into the volume of the suitcase defined by the faces of the suitcase body. The handle therefore does not project and coincides with an edge of the suitcase (or forms the suitcase edge), in the same manner that tubes 21 coincide with the suitcase edges.

To do this, the handle presents a cross section (shown in FIG. 9) that comprises an outer portion 31, facing the outside of the suitcase when the handle is in the retracted position, and an inner portion 32 that faces the inside of the suitcase (and therefore faces the upper recessed edge 14 and the rigid intermediate part 27) when the handle is in the retracted position.

The outer portion 31 defines an arch (or a curve) that presents two ends 33 and 34. When the handle 18 is in the retracted position, the ends 33 and 34 form arch portions whose extreme tangents are found in the extension of the planes defined by, respectively, the back face 9 of the suitcase and the top face 10 of the suitcase.

The inner portion 32 is configured so that, when the handle 18 is in the retracted position (FIG. 8 or 9), a free space 29 is present between the handle and the rigid intermediate part 27.

This free space 29 enables the user's fingers to slide under the handle so as to be able to grip the handle and cause it to pass from the retracted position to the extended position.

As can be seen in FIGS. 1 to 3, for example, the suitcase also comprises a second upper fixed handle 35, attached to upper face 10, particularly to the part of the upper face made by shell 3. The suitcase also comprises a third lateral fixed handle 36, attached to the lateral face 7 of the suitcase, particularly on the part of the lateral face made by shell 3.

The upper fixed handle 35 offers the user a grip member to manually move the suitcase without having to extend the twin rod 16.

The lateral fixed handle 36 offers the user a grip member to grip the suitcase manually by the lateral side of the suitcase (for example to go up or down stairs).

Tubes 21 can be made of metal or any other material that is preferably light and strong. In order to not damage or deform the tubes, devices enabling shocks to be absorbed can be provided near the tubes.

Figure 7:
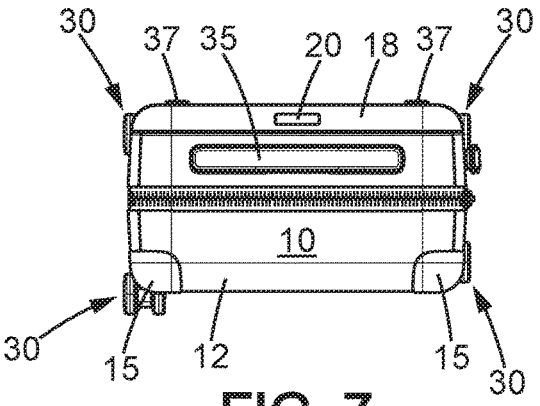
FIG. 7 is a top view of the suitcase shown in FIG. 1.
Figure 6:
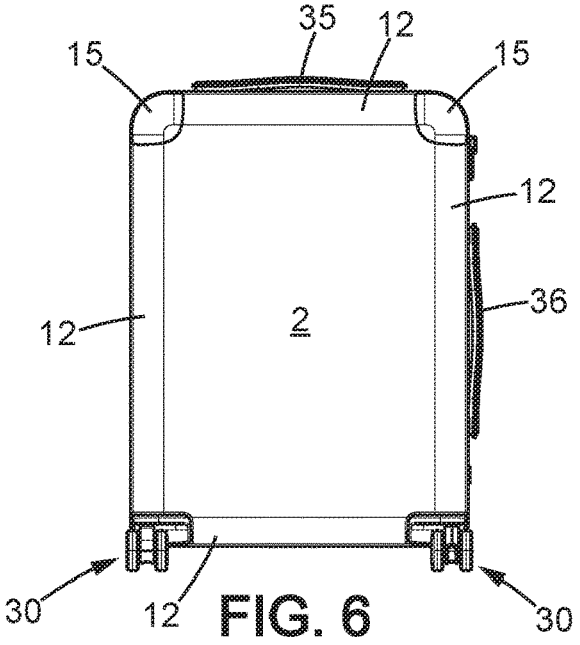
FIG. 6 is a front view of the suitcase shown in FIG. 1.

FIGS. 4, 5 and 7 show damping elements 37, attached to the back face 9 of the suitcase parallel to tubes 21 at the lower part of back face 9.

The damping elements can be made of plastic or rubber. Such elements can also be provided directly onto tubes 21. According to another variant of embodiment, tubes 21 themselves can be made in a material that is able to absorb shocks.

It is understood from the previous description how the invention provides an elegant, compact, strong and functional suitcase.

Thus produced, the suitcase comprises a twin rod 16 that is inconspicuous because it coincides with the contour of the suitcase. The rod 16 not only enables the suitcase to be pulled but also, thanks to its layout, provides additional rigidity over three of the suitcase edges. Another advantage provided by the layout of the rod is that the two tubes themselves can protect against shocks, for example shocks that can damage the low structure of the suitcase, when it is, for example, pulled to mount sidewalk or stairway steps.

However, it should be understood that the invention is not specifically limited to the embodiment presented in the figures and that it extends to the implementation of any equivalent means.

The invention claimed is:

1. A wheeled suitcase comprising:

a rigid or semi-rigid suitcase body, mounted on wheels, said body comprising at least three rigid or semi-rigid lateral faces separated by two edges, and a telescopic twin rod comprising two arms, a handle and two tubes, the arms being connected to the handle and slidingly mounted in both tubes, wherein the two tubes are disposed along the two edges outside the body of said suitcase, each of the two edges is recessed, presenting a concavity facing the outside of the suitcase body, the tubes are received in the recessed edges, and each of the tubes presents a profile with a cross section defined by an outer portion and an inner portion, the outer portion defining an arch presenting two ends, wherein the outer portion extends in the vicinity of the two ends tangentially to two contiguous lateral faces to the edge in which the tube is received, the inner portion being configured to substantially follow the concavity of said recessed edge in which the tube is received.

2. The wheeled suitcase according to claim 1, wherein the tubes are attached to the two edges by rivets or screws.

3. The wheeled suitcase according to claim 1, wherein the tubes present open ends by which the arms are introduced, and wherein a rigid intermediate part is positioned between the tubes and extends from the open end of one tube to the open end of the other tube.

4. The wheeled suitcase according to claim 3, wherein one of the lateral faces is a back face of the suitcase body, and wherein said suitcase body comprises a top face separated from the back face by an upper edge of the suitcase body, said upper edge being recessed, presenting a concavity facing the outside of suitcase body, the rigid intermediate part having a shape complementary to the concavity of the upper edge and the intermediate part being fixed in said upper edge.

5. The wheeled suitcase according to claim 4, wherein the handle is movable between a retracted position and an extended position and comprises, over at least one portion of its length, a cross section defined by the outer handle portion and an inner handle portion, the outer handle portion defining an arch presenting two ends, the two ends being found in the extension of the planes defined by, respectively, a lateral face of suitcase body and the top face of suitcase body.

6. The wheeled suitcase according to claim 5, comprising a free space between the handle and the rigid intermediate part in the retracted position of the handle.

7. The wheeled suitcase according to claim 1, also comprising at least two wheeled devices which are rotatable around two respective pivot axes, said wheeled devices being mounted on a bottom face of the suitcase body.

8. The wheeled suitcase according to claim 7, wherein the tubes present a tube end situated in the vicinity of a wheeled device, said tube end presenting an edge defining an inner space of the tube, and wherein the pivot axis of the wheeled device extends in said inner space of the tube.

9. The wheeled suitcase according to claim 7, wherein each wheeled device is attached in the vicinity of a tube with which it is associated, and each of the two pivot axes is parallel to a main axis of the tube with which said wheeled device is associated, a pivot axis of a wheeled device being spaced apart from an associated main tube axis by a distance of less than 20 millimeters, preferably zero millimeters.

10. The wheeled suitcase according to claim 7, wherein each of the wheeled devices is fixed to an element mounted on a tube.

11. The wheeled suitcase according to claim 7, wherein each wheeled device is attached in the vicinity of a tube with which it is associated, and each of the two pivot axes is parallel to a main axis of the tube with which said wheeled device is associated, a pivot axis of a wheeled device being spaced apart from an associated main tube axis by a distance of zero millimeters.

12. The suitcase according to claim 1, comprising damping elements.

13. The suitcase according to claim 12, wherein the damping elements are parts mounted on a lateral face of said body of said suitcase, in the vicinity of the tubes.

14. The suitcase according to claim 12, wherein the tubes comprise said damping elements.

* * * * *